United States Patent [19]

Abo

[11] 4,274,381

[45] Jun. 23, 1981

[54] AIR/FUEL RATIO CONTROL SYSTEM EQUIPPED WITH A TEMPERATURE SENSOR FAIL-SAFE SYSTEM FOR AN INTERNAL COMBUSTION ENGINE

[75] Inventor: Toshimi Abo, Yokohama, Japan

[73] Assignee: Nissan Motor Company, Limited, Yokohama, Japan

[21] Appl. No.: 35,302

[22] Filed: May 2, 1979

[30] Foreign Application Priority Data

Jun. 26, 1978 [JP] Japan ..... 53/76438

[51] Int. Cl.[3] ..... F02D 5/00

[52] U.S. Cl. ..... 123/479; 123/440; 123/489; 123/491; 60/285

[58] Field of Search ..... 123/32 EK, 32 EE, 119 EC, 123/32 EA, 32 EG, 32 EJ, 198 D, 32 EB; 60/285

[56] References Cited

U.S. PATENT DOCUMENTS

| | | | |
|---|---|---|---|
| 3,834,361 | 9/1974 | Keely | 123/32 EK |
| 3,906,207 | 9/1975 | Rivere et al. | 123/32 EB |
| 4,052,968 | 10/1977 | Hattori et al. | 123/119 EC |
| 4,132,193 | 1/1979 | Takase et al. | 123/32 EE |
| 4,202,301 | 5/1980 | Early et al. | 123/489 |

*Primary Examiner*—Charles J. Myhre
*Assistant Examiner*—Andrew M. Dolinar
*Attorney, Agent, or Firm*—Lowe, King, Price & Becker

[57] ABSTRACT

An air/fuel ratio control system equipped with a temperature sensor fail-safe system for an internal combustion engine, comprises an engine parameter detecting circuit for the estimation whether the engine coolant temperature sensor is normal or not, a constant voltage supply, and a switching circuit for transmitting the constant voltage to a control signal generator, in place of the output signal of the engine coolant temperature sensor, the control signal generator generating a control signal in accordance with various engine parameters including the engine temperature for the control of the air/fuel ratio of an air/fuel mixture supplied to the engine, thereby providing the control signal generator with a suitable signal when a failure occurs in the engine coolant temperature sensor to prevent undesirable operation.

8 Claims, 4 Drawing Figures

AIR/FUEL RATIO CONTROL SYSTEM EQUIPPED WITH A TEMPERATURE SENSOR FAIL-SAFE SYSTEM FOR AN INTERNAL COMBUSTION ENGINE

FIELD OF THE INVENTION

This invention generally relates to an air/fuel ratio control system for an internal combustion engine. More particularly, the present invention relates to such a system equipped with a fail-safe system for the engine temperature sensor used in the air/fuel control system.

BACKGROUND OF THE INVENTION

In electrically controlled fuel or air/fuel mixture supply systems such as a fuel injection system and a electronically controlled carburetor system, various engine and vehicle operational parameters are utilized for the precise control of the air/fuel ratio of an air/fuel mixture supplied to an internal combustion engine. The precise control of the air/fuel ratio is required for obtaining clean exhaust gases, high engine operational performance and for the improvement of the fuel consumption characteristic.

As an example, in an electronic fuel injection system, the fuel flow rate is determined basically in accordance with the amount of intake air and the rotational speed of the crankshaft of the engine. However, various parameters such as engine coolant temperature, atmospheric air pressure, and intake air temperature, are used for the correction or modification of the fuel flow rate basically determined by the above two major parameters. Furthermore, in a closed loop air/fuel ratio control system, a gas sensor is used to detect the concentration of a component in the exhaust gases to perform a feedback control.

In the above parameters, the engine coolant temperature is one of the important parameters since this parameter is used to supply a rich air/fuel mixture to an internal combustion engine during warming up so as to render the engine rotation smooth and accelerate the warming up. Usually, the engine temperature is sensed by a temperature sensor such as a thermister, disposed in the water jacket in the engine casing to be exposed to the engine coolant.

A problem occurs when the engine temperature sensor is out of order. If the output signal of the temperature sensor does not change in accordance with the variation in engine coolant temperature, an undesirable phenomenon is apt to occur. For instance, a rich mixture is continuously supplied to the engine even after the engine is warmed up enough. In this case, the efficiency of the mechanism for the purification of the exhaust gases, such as a catalytic converter, and the fuel consumption characteristic may be deteriorated.

SUMMARY OF THE INVENTION

This invention has been developed in order to remove the above mentioned drawbacks and disadvantages of the conventional air/fuel ratio control systems.

It is, therefore, an object of the present invention to provide an air/fuel ratio control system equipped with a temperature sensor fail-safe system for an internal combustion engine.

Another object of the present invention is to provide such a system in which the efficiency of the purification of the exhaust gases is maintained at a given level, while the fuel consumption characteristic is prevented from being deteriorated.

A further object of the present invention is to provide such a system in which an engine parameter is detected for the inference or estimation of the actual engine temperature.

A still further object of the present invention is to provide such a system in which a predetermined signal is fed to the control signal generator in place of the output signal of the engine temperature sensor when failure occurs in the temperature sensor.

BRIEF DESCRIPTION OF THE DRAWINGS

Reference is now made to the drawings accompanying the application, wherein.

DETAILED DESCRIPTION OF THE PREFERRED EMBODIMENTS

Figure 1:
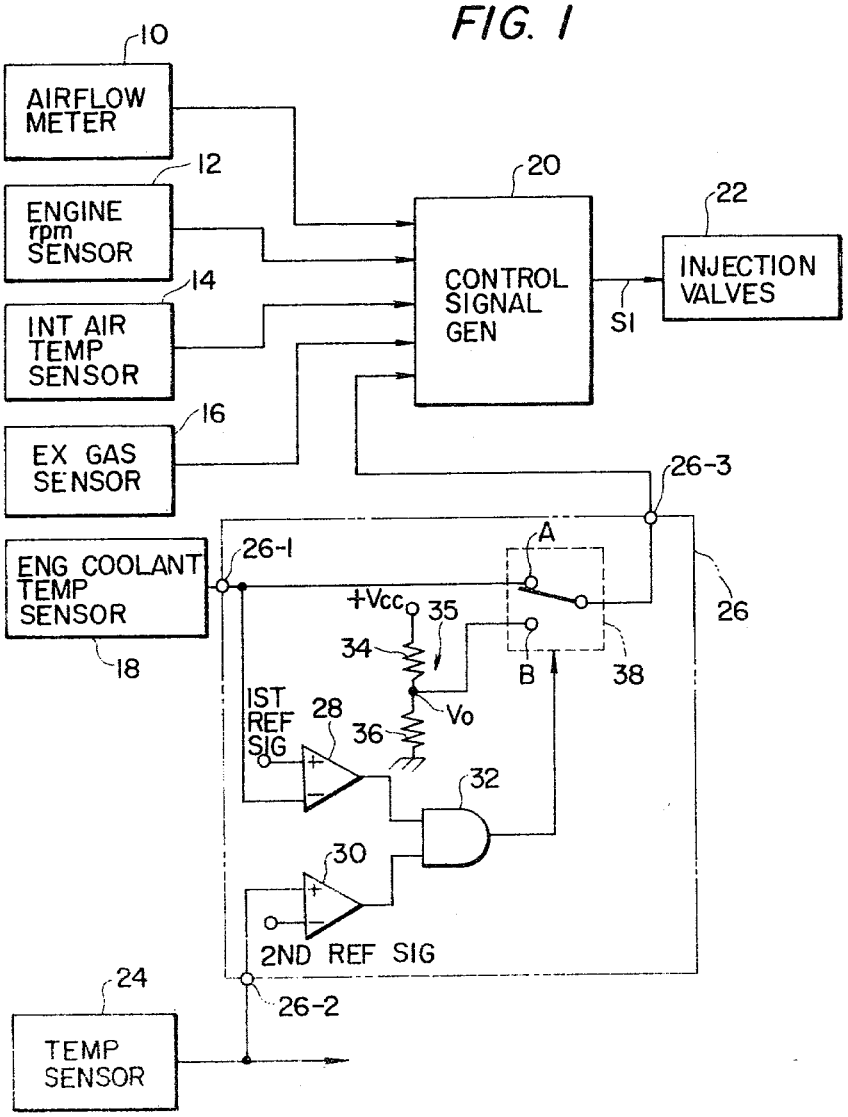
FIG. 1 is a block diagram of a first embodiment of the air/fuel control system.

Referring to FIG. 1, a block diagram form of a first embodiment of the air/fuel control system equipped with a temperature sensor fail-safe system for an internal combustion engine according to the present invention is shown. The system includes various sensors for the detection of engine operational condition, a control signal generator 20 and a series of fuel injection valve 22. In the embodiment shown a fuel injection system is taken for the explanation. However, an electronically controlled carburetor system may used instead.

Five conventional sensors, i.e. an airflow meter 10, an engine rpm sensor 12, an intake air temperature sensor 14, an exhaust gas sensor 16 and an engine coolant temperature sensor 18 are provided. The outputs other than the engine coolant temperature sensor 18 are directly connected to inputs of the control signal generator 20 which produces an output signal $S_1$ in accordance with various input signals. The output signal $S_1$ of the control signal generator 20 is fed to a series of injection valves 22 to energize the same to let a given amount of fuel into each cylinder of an internal combustion engine (not shown). Since the combination of various sensors, a control signal generator and a series of injection valves are well known and are conventional, the operation thereof is not further discussed.

The output of the engine coolant temperature sensor 18 is connected to an input of electrical circuitry 26 enclosed by a dot-dash line. The circuitry 26 has an output 26–3 connected to an input of the control signal generator 20. An additional temperature sensor 24 which will be discussed hereinbelow, is provided to supply the circuitry 26 with information. The additional temperature sensor 24 is used for the estimation of the failure of the engine coolant temperature sensor 18. The additional temperature sensor 24 is arranged to detect a temperature which varies as a function of the temperature of the engine. For instance, a temperature sensor of a catalytic converter, the exhaust gases or the lube (lubricating oil) may be used as the additional temperature sensor 24. When one of these temperature sensors is installed and used for other purposes, no additional temperature sensor is required. Assuming that the additional temperature sensor 24 is one disposed in the catalytic converter, the additional temperature sensor 24 produces an output signal indicative of the temperature of the catalyst. It is to be noted that this temperature indicated by the additional temperature sensor 24 output signal also indicates the engine temperature indirectly since the temperature of the catalyst varies as a function of the engine temperature.

The construction of the electrical circuitry 26 will be described hereinbelow. The circuitry includes first and second input terminals 26-1 and 26-2, and the previously mentioned output terminal 26-3. The circuitry 26 has first and second comparators 28 and 30, an AND gate 32, a voltage divider 35, and a switching circuit 38. The output of the engine coolant temperature sensor 18 is connected via the first input terminal 26-1 to an inverting input (−) of the first comparator and to a first contact A of the switching circuit 38. The output of the additional temperature sensor 24 is connected via the second input terminal 26-2 to the noninverting input (+) of the second comparator 30. First and second reference signals are produced by suitable voltage dividers (not shown) respectively and are applied to the noninverting input (+) of the first comparator 28 and to the inverting input (−) of the second comparator 30. The outputs of the both first and second comparators 28 and 30 are respectively connected to first and second inputs of the AND gate 32. The output of the AND gate is connected to the switching circuit 38 to control the movable lever thereof. Although the switching circuit 38 is illustrated as of a mechanical type such as a relay, an electronic switching element, such as a switching transistor may be used instead. The switching circuit 38 has the above mentioned first contact A and a second contact B which are both stationary, and the above-mentioned movable contact connected via the output terminal 26-3 to an input of the control signal generator 20. The second contact B is connected to a junction between two resistors 34 and 36 which constitute the before mentioned voltage divider 35. The voltage divider 35 is interposed between a positive power supply +Vcc and ground. The voltage divider 35 is arranged to develop a predetermined voltage $V_o$ by dividing the voltage of the power supply +Vcc. It will be understood that one of the voltages at the stationary contacts A and B of the switching circuit 38 will be selectively fed to the control signal generator 20 in accordance with the position of the movable contact.

The detailed operation of the circuitry 26 will be described hereinbelow. The first comparator 28 produces a high level output signal when the temperature indicated by the engine coolant temperature sensor 18 is below a predetermined value (such as 80 degree centigrade) indicated by the first reference signal, by comparing the voltages thereof. The second comparator 30 produces a high level output signal when the temperature indicated by the additional temperature sensor 24 is over a predetermined value indicated by the second reference signal. The predetermined value indicated by the second reference signal corresponds to the temperature of the catalyst upon sufficiently warmed up condition of the engine, in case that the additional temperature sensor 24 is one disposed in the catalytic converter. Of course, when a lube temperature sensor is used as the additional temperature sensor 24, the predetermined value has to correspond to the temperature of the lube under the same condition as the above.

Since the outputs of the first and second comparators 28 and 30 are connected to the inputs of the AND gate 32, the AND gate 32 produces a high level output signal when the above mentioned two conditions are fulfilled. In other words, the AND gate 32 produces a high level signal when the engine coolant temperature is below the first predetermined value, and when the other temperature (of the catalyst, lube or other) is above the second predetermined value. It will be understood, therefore, that the high level output signal of the AND gate 32 indicates that failure occurs in the engine coolant temperature sensor 18 since the engine coolant temperature sensor 18 indicates a low temperature even though it is inferred (estimated or conjectured) by the temperature indicated by the additional temperature sensor 24 that the engine temperature must be above a predetermined value.

The switching circuit 38 is arranged to transmit the output signal of the engine coolant temperature 18 directly to an input of the control signal generator 20 when a low level signal is applied from the AND gate 32. When a high level signal is supplied to the switching circuit 38 from the AND gate 32, the movable lever which is normally in contact which the first stationary contact A, enters into contact with the second stationary contact B to transmit the predetermined voltage $V_o$ produced by the voltage divider 35 to the control signal generator 20 in place of the output signal of the engine coolant temperature sensor 18. The voltage $V_o$ is so predetermined that it corresponds to the voltage of the engine coolant temperature sensor 18 output signal under normal condition (for instance the coolant temperature is at 80 degrees centigrade). With this arrangement, when failure occurs in the engine coolant temperature sensor, the predetermined voltage $V_o$ which corresponds to a normal temperature of the coolant is fed to the control signal generator 20 irrespectively of the temperature indicated by the output signal of the engine coolant temperature sensor 18. Accordingly, the control signal generator 20 operates as usual although the engine coolant temperature sensor 18 is out of order so that it is prevented that an undesirable operation such as a supply of exceedingly rich mixture to the engine takes place.

It will be seen, that the combination of the first and second comparators 28 and 30 and the AND gate 32 functions as a detector of failure of the engine coolant temperature sensor 18, and the switching circuit 38 is controlled by the output signal of the AND gate 32 to selectively supply the output signal of the engine coolant temperature sensor 18 and the predetermined voltage $V_o$ to the control signal generator 20.

Figure 2:
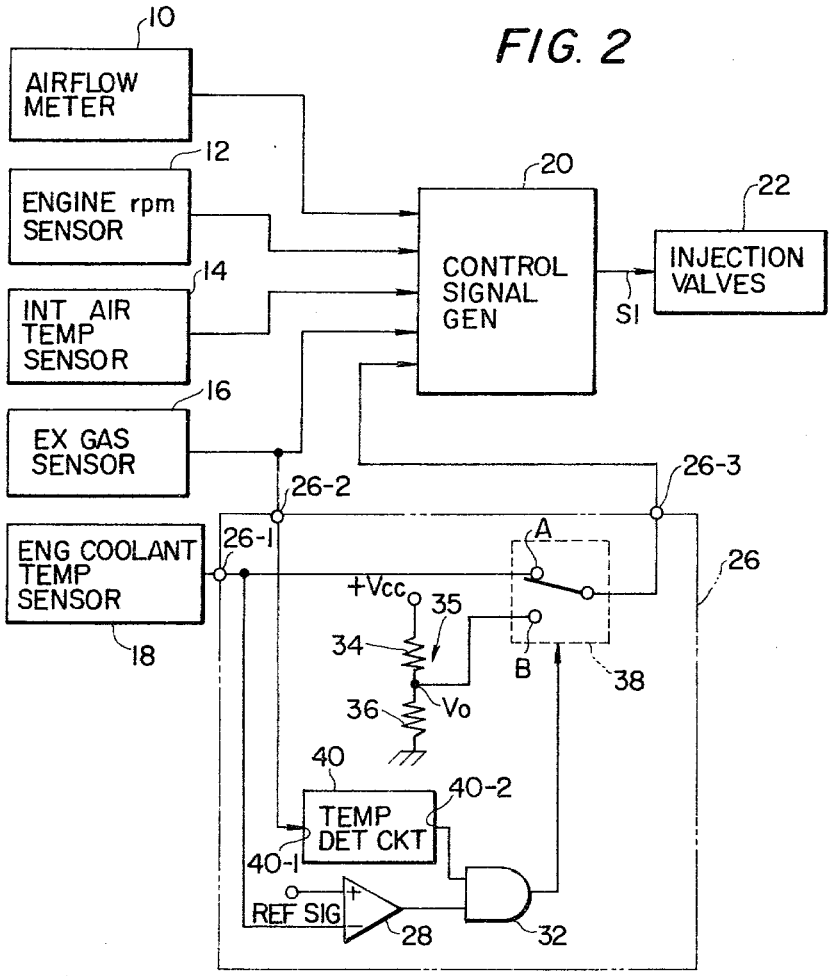
FIG. 2 is a schematic block diagram of a second embodiment of the air/fuel ratio control system.

Reference is now made to FIG. 2 which shows a schematic block diagram form of a second embodiment of the air/fuel ratio control system according to the present invention. The same circuits and elements as in the first embodiment shown in FIG. 1 are designated by like numerals. The second embodiment has the same construction as the first embodiment except that the additional temperature sensor 24 in the first embodiment is omitted and the output signal of the exhaust gas sensor 16 is used to detect failure of the engine coolant temperature sensor 18, while the second comparator 30 in the first embodiment is substituted with a temperature detection circuit 40 the detailed circuit diagram of which is shown in FIG. 3.

Figure 3:
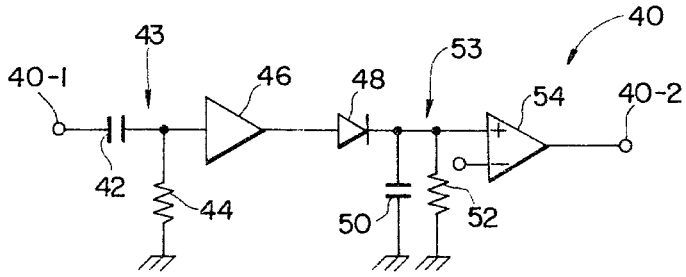
FIG. 3 shows the temperature detection circuit.

As illustrated in FIG. 3 the temperature detection circuit 40 includes an input terminal 40-1 and an output terminal 40-2 which are also shown in FIG. 2. A capacitor 42 is interposed between the input terminal 40-1 which is connected, via a second input terminal 26-2 of the circuitry 26, to the output of the exhaust gas sensor 16 and an input of a buffer amplifier 46 the output of which is connected to an anode of a diode 48. The input of the buffer amplifier 46 is connected via a resistor 44 to ground. These capacitor 42 and resistor 44 constitute a differentiator 43. The cathode of the diode 48 is connected to a noninverting input (+) of a comparator 54. The comparator 54 has an inverting input (−) for the reception of a reference signal. A parallel circuit of a capacitor 50 and a resistor 52 is interposed between the cathode of the diode 48 and ground. This parallel circuit functions as a charge-discharge circuit 53 as will be described later. The output of the comparator 54 is connected to the output terminal 40-2 which in turn is connected to the first input of the AND gate shown in FIG. 2.

The operation of the second embodiment will be described in connection with FIG. 2 and FIG. 3. It is well known that the internal impedance of gas sensors, such as a zirconium type oxygen sensor, is so high at low temperatures that the maximum voltage of the output signal therefrom is exceedingly low. It will be understood that in this second embodiment, the variation in output voltage of the exhaust gas sensor 16 is detected for the purpose of estimating the temperature of the exhaust gases and therefore the engine temperature indirectly.

The output signal of the exhaust gas sensor 16 is supplied to the differentiator 43 so that the differentiator 43 produces an output signal the magnitude of which is proportional to the degree of the variation in the voltage of the output signal of the gas sensor 16. The differentiated signal is applied via the buffer circuit 46 and the diode to the charge-discharge circuit 53. Accordingly, the voltage across the capacitor 50 included in the charge-discharge circuit 53 varies in accordance with the voltage of the differentiated signal and the frequency of the occurrence of the differentiated signal. In other words, when the output voltage of the gas sensor 16 varies normally frequently within a normally wide range, the voltage across the capacitor 50 of the charge-discharge circuit 53 is maintained over a predetermined level. The comparator 54 produces a high level signal when the voltage across the capacitor 53 is above the voltage of the reference signal applied to the inverting input (−) thereof. This means that a high level signal is applied to the first input of the AND gate 52 via the output terminal 40-2 of the temperature detection circuit 40 only when the temperature of the exhaust gases, to which the gas sensor 18 is exposed, is above a predetermined value. In this way, it will be understood, that the temperature of the engine is conjectured by means of the variation in the output voltage of the gas sensor 16. Since the maximum and minimum values in voltage of the output signal of the gas sensor 16 respectively vary as functions of the temperature, these values may be detected by a suitable circuit, such as a peak level detector, instead of detecting the variation.

Although, in this second embodiment the output signal of the gas sensor 16 is used for the inference or estimation of the engine temperature, if the control signal generator 20 is equipped with a disable circuit which disables the feedback operation of the closed loop air/fuel ratio control system when the maximum voltage of the output signal of the gas sensor 16 is below a predetermined value, or the variation range of the output signal is within a predetermined value, the output signal of the disable circuit may be used in place of the output signal of the temperature detection circuit 40. In other words, the output of the disable circuit may be connected to the first input of the AND gate 32 so that the temperature detection circuit 40 is unnecessary.

Figure 4:
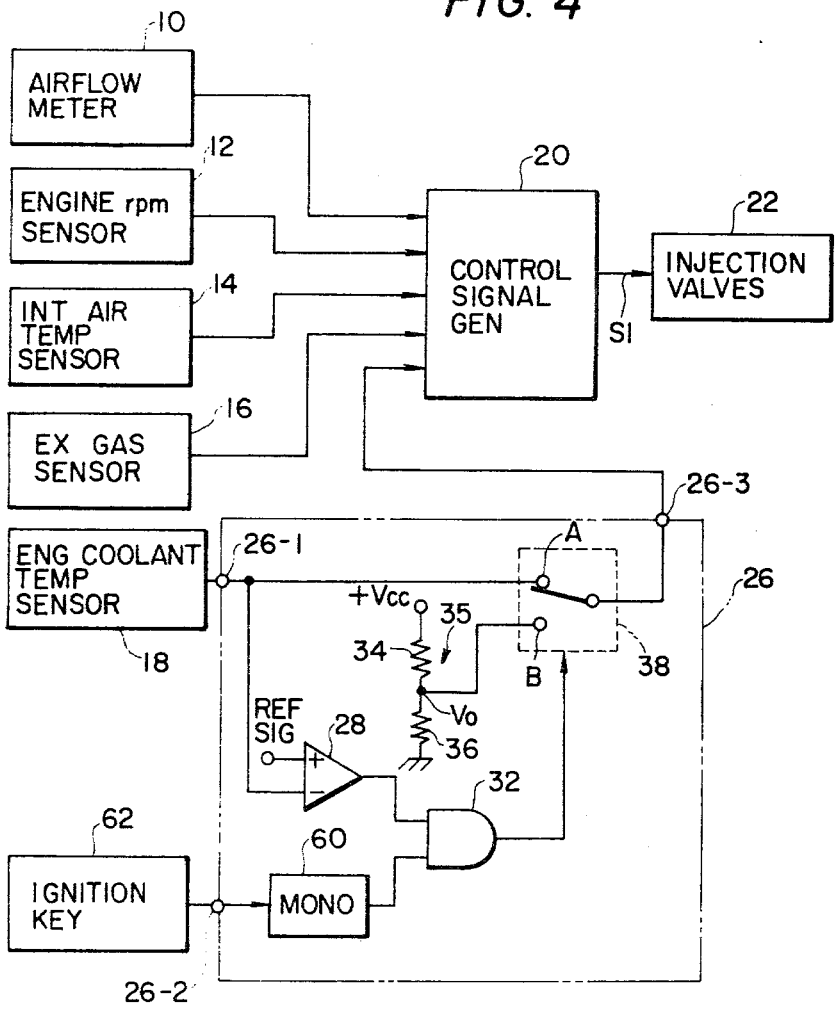
FIG. 4 shows in block diagram form a third embodiment of the air/fuel control system equipped with a temperature sensor fail-safe system for an internal combustion engine.

Reference is now made to FIG. 4 which shows in block diagram form a third embodiment of the air/fuel control system equipped with a temperature sensor fail-safe system for an internal combustion engine according to the present invention. In this embodiment, the state of the ignition key of the engine is detected for the approximate estimation of the engine temperature. The same elements as in the previous embodiments are designated by the same reference numerals.

A conventional ignition key 62 is used to produce a signal with which a monostable multivibrator 60 is triggered. The output of the monostable multivibrator 60 is connected to one input of the AND gate 32 while the other input of the AND gate 32 is responsive to the output signal of the comparator 28 whose connection and function are the same as those in the preceeding embodiments. The time constant of the monostable multivibrator 60 is so adjusted that the width of the output pulse of the monostable multivibrator 60 corresponds to a duration with which it is supposed that the engine is warmed up enough after started.

The third embodiment shown in FIG. 4 operates as follows. When the ignition key 62 is turned on to start the engine, a high level signal or a pulse signal is applied to the input of the monostable multivibrator 60 so that monostable multivibrator, which functions as a timer circuit, produces a low level pulse signal the width of which is predetermined.

For this predetermined period of time the AND gate 32 is disabled and thus a low level signal is fed from the output of the AND gate 32 to the switching circuit 38, maintaining the movable contact of the switching circuit 38 being in contact with the first stationary contact A to transmit the output signal of the engine coolant temperature sensor 18 to the control signal generator 20. After this predetermined period of time, the output signal of the monostable multivibrator 60 turns high to enable the AND gate 32 to transmit the output signal of the comparator 28 to the switching circuit 38. At this time if the temperature indicated by the output signal of the engine coolant temperature sensor 18 is below the previously mentioned reference value, a high level signal is produced by the comparator 28 and this high level signal is fed via the AND gate 32 to the switching circuit 38 to change the position of the movable contact from the first stationary contact A to the second stationary contact B to transmit the predetermined voltage $V_o$ from the voltage divider 35 to the control signal generator 20.

If desired, the pulse width of the monostable multivibrator output may be changed manually by changing the time constant thereof so that the duration, for which the AND gate 32 is disabled, is adjustable. This is advantageous since duration required for the sufficient warming up of the engine varied in accordance with the air temperature. Namely, in winter the pulse width may be lengthened since period of time necessary for the warming up is longer than that in other seasons.

From the foregoing, it will be understood, that in the air/fuel ratio control system according to the present invention it is detected whether the engine coolant temperature is normal or not by means of the estimation inference of the engine temperature in view of other engine parameter.

It will be further understood that if a microcomputer is used in the control system of the engine, the same microcomputer may be used in place of the circuitry 26 shown in FIGS. 1, 2 and 3 by changing the program of the operation. Many modifications and changes may be made without departing from the spirit of the invention.

What is claimed is:

1. In an air/fuel ratio control system for an internal combustion engine, including sensors for detecting engine parameters, said sensors including an engine temperature sensor for producing an output signal indicative of the engine temperature, a control signal generator responsive to the detected engine parameters, and one of a fuel supply mechanism and air/fuel mixture supply mechanism responsive to a control signal from said control signal generator for supplying one of fuel and air/fuel mixture to said engine; wherein the improvement comprises:

(a) first means for providing an engine parameter signal indicative of the engine temperature;

(b) second means for detecting whether said engine temperature sensor is in a normal or abnormal operative condition in view of said engine parameter signal;

(c) third means for producing a predetermined voltage having a magnitude which corresponds to a voltage of the output signal of said engine temperature sensor under conditions of normally high temperatures; and (d) fourth means for selectively transmitting the output signal of said engine temperature sensor and said predetermined voltage in accordance with a normal or abnormal condition of said engine temperature sensor detected by said second means.

2. An air/fuel ratio control system as claimed in claim 1, wherein said first means comprises a temperature sensor disposed in a catalyst of a catalytic converter.

3. An air/fuel ratio control system as claimed in claim 1, wherein said first means comprises an engine lube temperature sensor.

4. An air/fuel ratio control system as claimed in claim 1, wherein said first means comprises a temperature sensor disposed in an exhaust gas passage of said engine.

5. An air/fuel ratio control system as claimed in claim 1, wherein said second means comprises first and second comparators respectively responsive to output signals of said engine temperature sensor and said first means, and a gate circuit responsive to output signals of said first and second comparators.

6. An air/fuel ratio control system as claimed in claim 1, wherein said first means comprises an exhaust gas sensor for producing a signal indicative of the concentration of a component contained in the exhaust gases, and wherein said second means comprises a comparator responsive to the output signal of said engine temperature sensor, a circuit which detects the degree of the variation in a voltage of an output signal of said exhaust gas sensor, and a gate circuit responsive to output signals of said comparator and said circuit.

7. An air/fuel ratio control system as claimed in claim 6, wherein said circuit comprises:

(a) a differentiator responsive to the output signal of said gas sensor; and (b) a charge-discharge circuit including a capacitor for producing an output signal when the voltage exceeds a predetermined voltage.

8. An air/fuel ratio control system as claimed in claim 1, wherein said first means includes an ignition key of said engine, said ignition key producing an output signal when turned on to start said engine, a timer circuit responsive to the output signal of said ignition key, and wherein said second means comprises a comparator responsive to the output signal of engine temperature sensor, and a gate circuit responsive to output signals of said comparator and said timer circuit.

* * * * *